US006658705B2

(12) United States Patent
Yoon

(10) Patent No.: US 6,658,705 B2
(45) Date of Patent: Dec. 9, 2003

(54) EXCHANGEABLE SELF-ADJUSTING DEVICE FOR USE IN BELT

(76) Inventor: Jong Sig Yoon, 542-10. #101 Sansoo Mansion Sansoo-dong, Dong-gu, Kwangiu-city (KR)

( * ) Notice: Subject to any disclaimer, the term of this patent is extended or adjusted under 35 U.S.C. 154(b) by 0 days.

(21) Appl. No.: 10/278,381

(22) Filed: Oct. 23, 2002

(65) Prior Publication Data

US 2003/0110597 A1 Jun. 19, 2003

(30) Foreign Application Priority Data

Dec. 17, 2001 (KR) ..... 2001-38863

(51) Int. Cl.[7] ..... A44B 11/12; A44B 11/25

(52) U.S. Cl. ..... 24/192; 24/191; 24/68 R; 24/163 R; 24/334

(58) Field of Search ..... 24/192, 191, 163 R, 24/185, 195, 194, 68 R, 68 E, 71.1, 334; 297/478

(56) References Cited

U.S. PATENT DOCUMENTS 1,605,441 A * 11/1926 Kallajian ..... 24/192
5,158,450 A * 10/1992 Horita et al. ..... 24/68 R
5,291,638 A * 3/1994 Huang ..... 24/191
5,920,963 A * 7/1999 Chou ..... 24/191
6,101,689 A * 8/2000 Jo ..... 24/334

* cited by examiner

*Primary Examiner*—Victor Sakran

(74) *Attorney, Agent, or Firm*—Ladas & Parry

(57) ABSTRACT

Disclosed is an exchangeable self-adjusting device for use in a belt, in which a strap is properly extended due to a slight abdominal motion, and a wearer can easily exchange the buckle to follow the fashion. The device includes a cover 10 being movable left and right, a slidable body 20 inserted into a bottom of the cover 10, and a bottom plate 30 hinged to one portion of a bottom of the body 20 by means of a hinge 32. The cover 10 includes a cover hook 12 formed at a front thereof and inserted into a buckle hook 51 provided at a rear of a buckle 50, and a leaf-spring hooking boss 11 with a hooked groove 11*a* formed at its center. The body 20 includes detachable bosses 21 protruded from both sides thereof, a roller fixing shaft 23 formed at a center of a bottom thereof for rotatably fixing a roller 70, and a hinge protruded from both sides of the rear thereof towards the bottom and having a hinge hole 22. The bottom plate 30 includes a detachable portion 33 detachably engaged to the detachable bosses 21 of the body 20, a strip biting projection 31 formed in a spike shape for biting the strap 60 and extended integral with a hinge boss 32 of the bottom plate 30, and the hinged bosses 32 protruded from both sides of the strip biting projection 31 and inserted into the hinge hole 22 of the body 20. The leaf-spring 40 is wound many times around the roller 70, and including a leaf-spring hook 41 with its end bent in a U-shape to be inserted and secured to a hooked groove 11*a* of the leaf-spring hooking boss 11.

1 Claim, 4 Drawing Sheets

EXCHANGEABLE SELF-ADJUSTING DEVICE FOR USE IN BELT

BACKGROUND OF THE INVENTION

1. Field of the Invention

The present invention relates to an exchangeable self-adjusting device for use in a belt, and more particularly, to an exchangeable self-adjusting device for use in a belt, in which a strap is properly extended due to a slight abdominal motion, and a wearer can easily exchange the buckle to follow the fashion.

The present invention is based upon Korean Utility-Model Reg. No. 1996-0000072 entitled "Extension device for retractably adjusting length of strap" issued on Jan. 4, 1996 and assigned to the applicant, the contents of which are hereby incorporated by reference.

2. Description of the Related Art

As shown in FIG. 5, an extension device includes a retractable body 101 having one end securing a strap 104, and the other end fixed to a common buckle 105 by means of screws. The body 101 is provided at one side with a strip fixing gripper 111 by securing screws 124 to secure one end of the strap 104. A steel tape 118 is fixed to a steel tape fixing shaft 126 formed at a center of a steel tape receiving chamber 125. Also, the body 101 is provided at the other side with a leather attaching portion 127. A retractable strap piece 103 is guided by a steep tape spiral guide 123 of the leather attaching portion 127, and the end of the steel tape 118 is fixed to the strap 103 by use of a fixing hole 119 formed at the end of the steel tape. The body 101 is covered by a rear cover 114, and is fixed thereto by fastening screws 110 into threaded holes 122. The retractable strap piece is inserted into a leather case 102, and one end of the leather case 102 is adhered to the leather attaching portion 127. The strap 103 is interposed between the buckle 105 and an enclosure plate 106, and is fixed by use of screws 109

The conventional extension device is installed in the leather case 102 of the body 101 before the strap is worn by the wearer, as shown in FIG. 5, and then is fixed to the buckle 105 and the enclosure plate 106 by means of screws. With the construction, the tightened strap 103 is retracted, so that a length of the strap 104 may be extended.

When the steel tape 118 fixed to the steel tape fixing shaft 126 of the steel tape receiving chamber 125 goes out of the steel tape receiving chamber 125, the steel tape fixing shaft 126 is released in a 90 degrees twisted shape from the steel tape fixing shaft 126. Since the flat surface of the steel tape 118 is positioned in parallel to the flat surface of the strap 103, the steel tape 118 may be smoothly bent and stretched in the wearing state.

Since the strap 103 is fixed to the body 101 by means of the steel tape 118, even though the body is damaged due to exterior impact, it is impossible to exchange it. There is a drawback of again purchasing the strap.

With the construction in that the steel tape 118 is twisted at an angle of 90 degrees from the steel tape fixing shaft 126, there is another drawback in that the release of the steel tape 118 is impossible due to the rigidity of the steel tape 118 In addition, since the steel tape 118 is coupled to the body 101 and the strap 103, respectively, in an offset state, the strap 103 is released in the offset state, thereby causing the releasing operation to be not operated smoothly. Furthermore, upon actual operation of the strap 103, since the strap 103 is made of flexible material such as leather, it is easily bent, so that the sliding function of the extension device is not properly performed.

SUMMARY OF THE INVENTION

Accordingly, the present invention is directed to an exchangeable self-adjusting device for use in a belt that substantially obviates one or more problems due to limitations and disadvantages of the related art.

It is an object of the present invention to provide an exchangeable self-adjusting device for use in a belt, in which a strap is properly extended due to a slight abdominal motion, thereby preventing an oppressive sensation on an abdomen of a wearer.

Another object of the present invention is to provide an exchangeable self-adjusting device for use in a belt, capable of preventing trousers from being slip down due to the loose belt.

A further object of the present invention is to provide an exchangeable self-adjusting device for use in a belt, in which a wearer can easily exchange the buckle to follow the fashion, thereby saving a purchasing cost thereof. Still another object of the present invention is to provide an exchangeable self-adjusting device for use in a belt, in which a leaf spring can correctly move the self-adjusting device to improve the reliability thereof.

To achieve these objects and other advantages and in accordance with the purpose of the invention, as embodied and broadly described herein, there is provided an exchangeable self-adjusting device for use in a belt, one side of the self-adjusting device being coupled to an end of the belt, and the other side thereof being coupled to a buckle, the self-adjusting device comprising: a cover including a cover hook formed at a front thereof and inserted into a buckle hook provided at a rear of a buckle, and a leaf-spring hooking boss with a hooked groove formed at its center; a body including detachable bosses protruded from both sides thereof, a roller fixing shaft formed at a center of a bottom thereof for rotatably fixing a roller, and a hinge protruded from both sides of the rear thereof towards the bottom and having a hinge hole; a bottom plate including a detachable portion detachably engaged to the detachable bosses of the body, a strip biting projection formed in a spike shape for biting the strap and extended integral with a hinge boss of the bottom plate, and the hinged bosses protruded from both sides of the strip biting projection 31 and inserted into the hinge hole of the body; and a leaf-spring wound many times around the roller, and including a leaf-spring hook with its end bent in a U-shape to be inserted and secured to a hooked groove of the leaf-spring hooking boss.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, an example of which is illustrated in the accompanying drawings.

Figure 1:
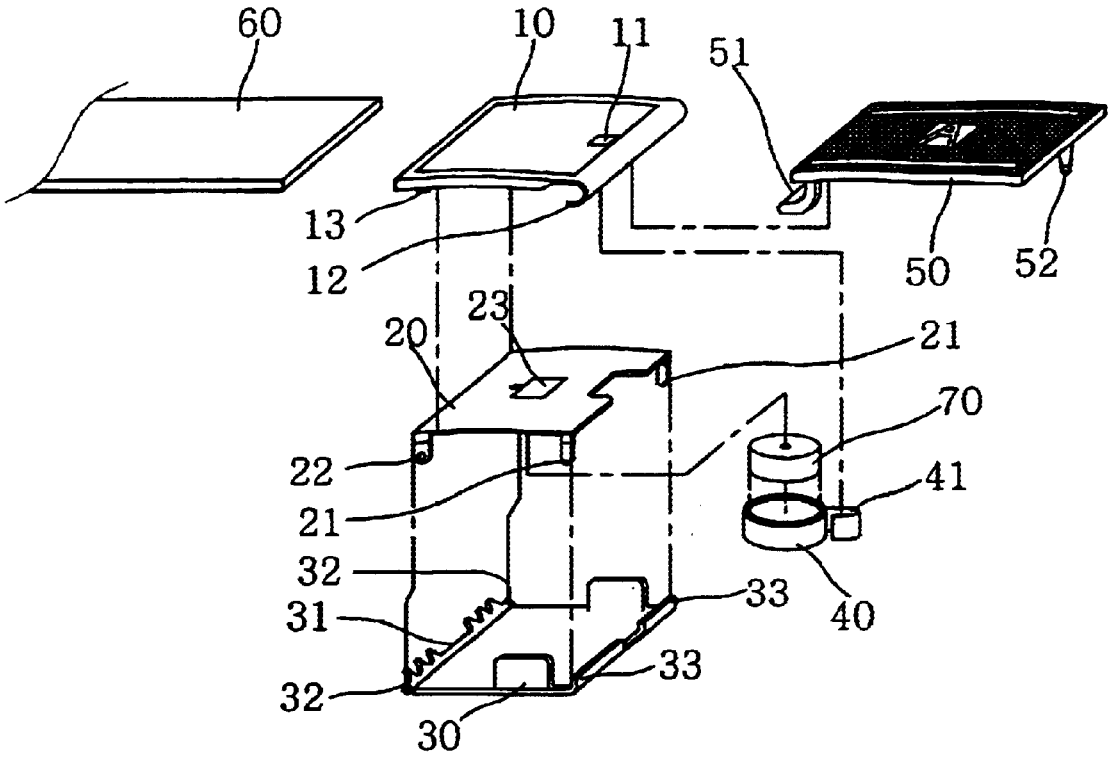
FIG. 1 is an exploded perspective view of an exchangeable self-adjusting device for use in a belt according to the present invention.
Figure 2:
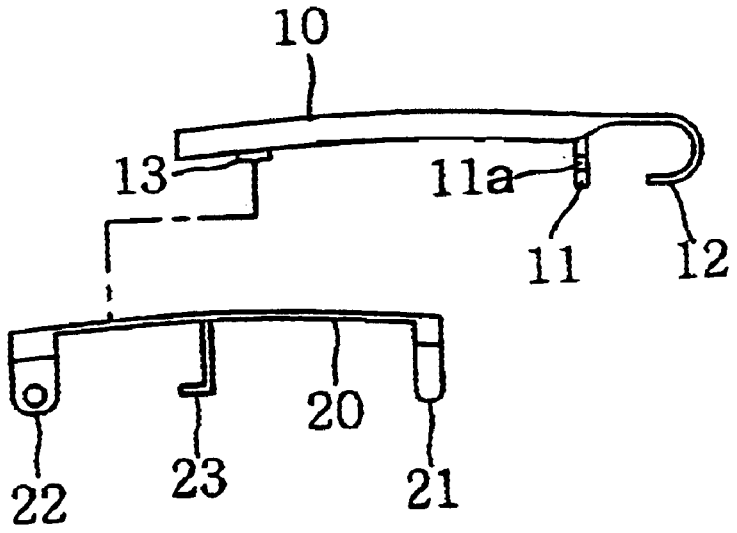
FIG. 2 is a cross sectional view of a cover and a body of an exchangeable self-adjusting device shown in FIG. 1.
Figure 3:
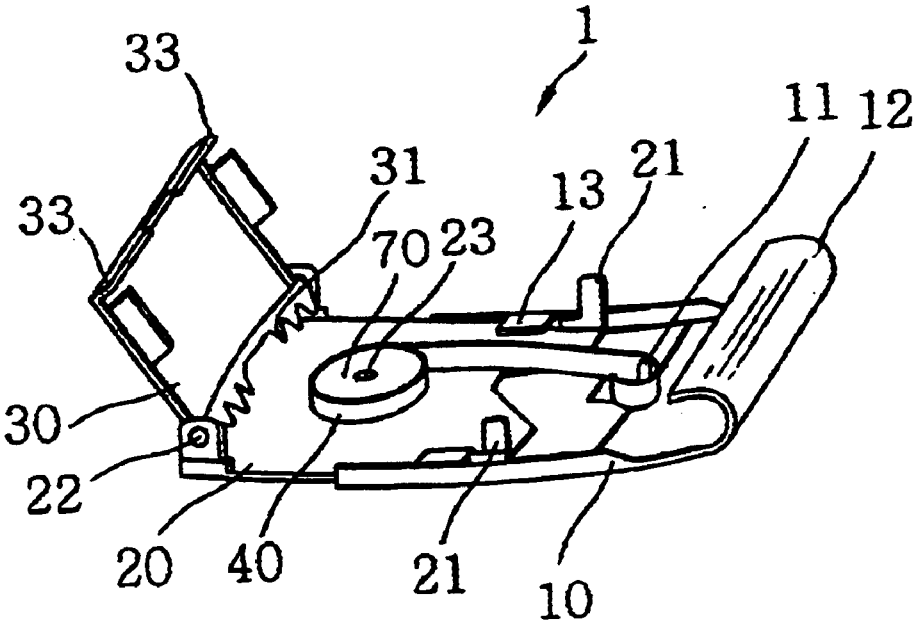
FIG. 3 is a perspective view of an exchangeable self-adjusting device according to the present invention.
Figure 4A:
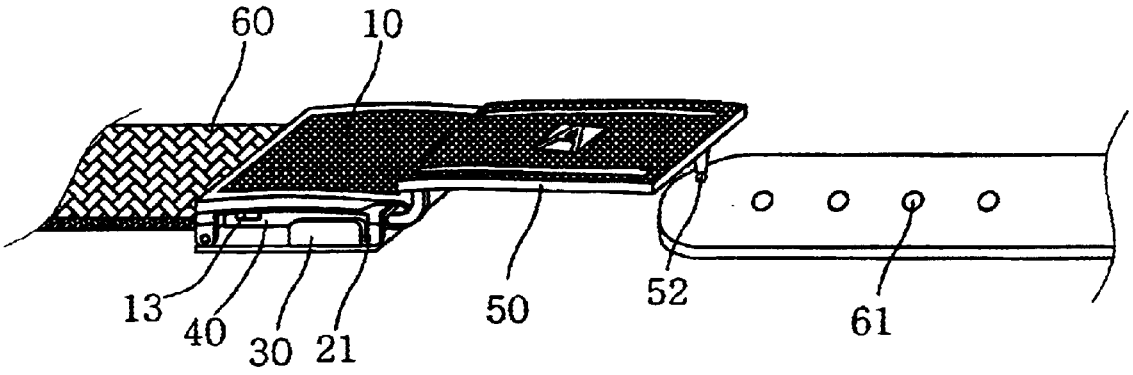
FIG. 4*a* is a perspective view for showing the state before a device operates.
Figure 4B:
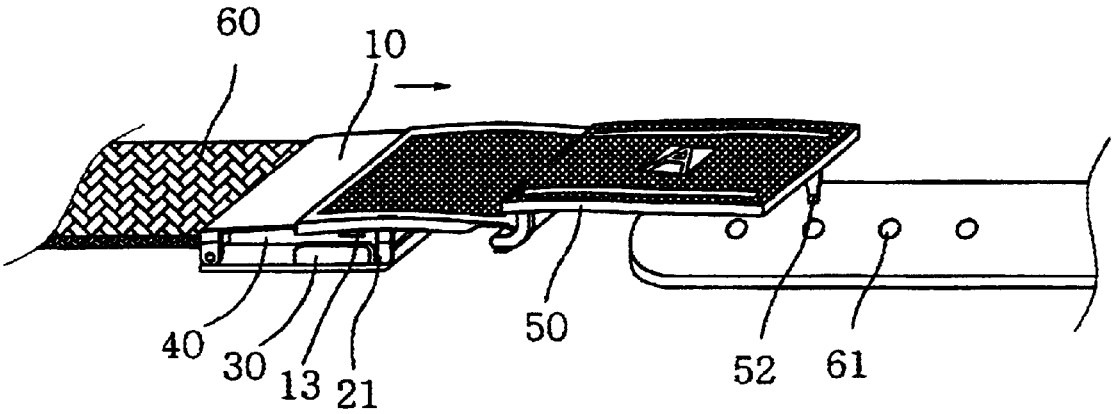
FIG. 4*b* is a perspective view for showing the state after a device operates.
Figure 5:
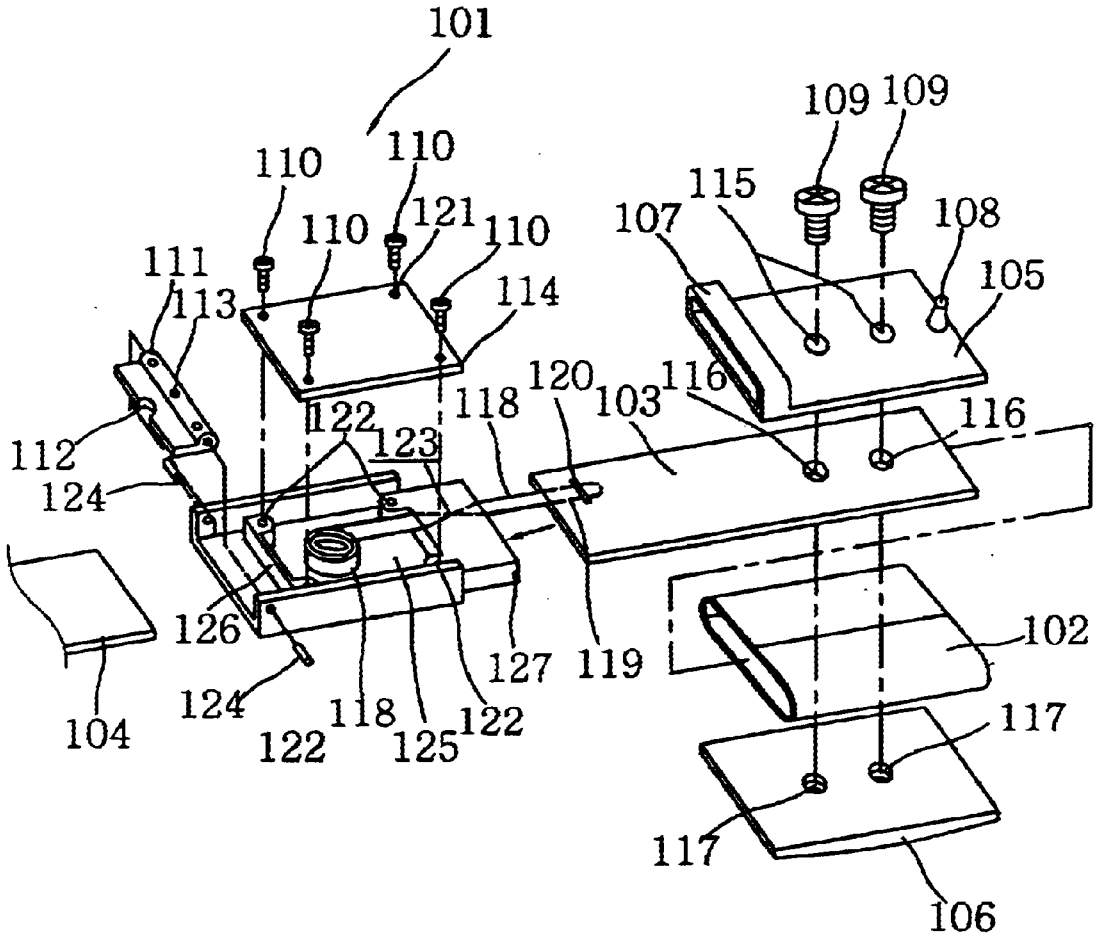
FIG. 5 is an exploded perspective view of a conventional belt.

As shown in FIG. 4, a self-adjusting device 1 for use in a belt according to the present invention includes a cover 10 being movable left and right, a slidable body 20 inserted into a bottom of the cover 10, and a bottom plate 30 hinged to one portion of a bottom of the body 20 by means of a hinge 32.

The cover 10 includes a cover hook 12 formed at a front thereof and inserted into a buckle hook 51 provided at a rear of a buckle 50, a leaf-spring hooking boss 11 with a hooked groove 11*a* formed at its center, and "L"-shaped locking bosses 13 protruded from both sides of a rear thereof.

The body 20 includes detachable bosses 21 protruded from both sides thereof, a "]"-shaped roller fixing shaft 23 formed at a center of a bottom thereof, and a hinge protruded from both sides of the rear thereof towards the bottom and having a hinge hole 22.

The body 20 is made of a plate, and is inserted into the bottom of the cover 10. The rear portion of the body 20 is supported by the locking bosses 13 of the cover 10, so that it may be slid in front and rear direction.

The bottom plate 30 includes a detachable portion 33 bent in an angle of 90 degrees and detachably engaged to the detachable bosses 21 of the body 20, a strip biting projection 31 formed in a spike shape for biting the strap 60, and hinged bosses 32 protruded from both sides of the strip biting projection 31 and inserted into the hinge hole 22 of the body 20.

The leaf-spring 40 of the present invention is wound many times in a shape of spiral spring, and has a leaf-spring hook 41 with its end bent in a U-shape.

The roller 70 with the leaf-spring 40 wound thereon is rotatably installed on the roller fixing shaft 23 of the body 20, and the leaf-spring hook 41 is inserted and secured to the hooked groove 11*a* of the leaf-spring hooking boss 11 formed at the bottom portion of the cover 10.

The cover hook 12 is engaged to the buckle hook 51, and the strip 60 is fixed by the strip biting projection 31. And then, if the buckle is pulled while holding the strip 60, the cover 10 coupled to the end of the leaf-spring 40 is resiliently moved, and, simultaneously, the roller 70 seated on the roller fixing shaft 23 of the body 20, so that the leaf-spring 40 wound around the roller 70 may be stretched.

Preferably, the roller fixing shaft 23 is provided in a shape of cylindrical column, so that when the leaf-spring 40 is stretched, the center portion of the rotating roller 70 is prevented from being abraded.

The leaf-spring 40 may be detached from the roller 70 and the leaf-spring hooking boss 11, so that it is possible to exchange only the leaf-spring 40 in case that the leaf-spring 40 is relaxed.

Explaining the operation and effects of the present invention constructed as described above, in order to couple the self-adjusting device 1 of the present invention to the strip 60, the bottom plate 30 is vertically rotated around the hinged boss 32, and then is inserted into the end of the strip 60. After that, the bottom plate 30 is again rotated horizontally.

At that time, the strip biting projection 31 of the bottom plate 30 bites the strap 60 to secure it.

The cover hook 12 formed at the front of the cover 10 is inserted into the buckle hook 51 provided at the rear of the buckle 50.

At that state, the wearer inserts a buckle fixing boss 52 into a hole 61 of the strap. If the boss 52 is not properly aligned with the hole, as shown in FIG. 4*a*, the wearer can easily insert the buckle fixing boss 52 into the hole 61 by moving the buckle 50 by a constant distance.

Upon pulling the buckle 50, the cover 10 coupled to the end of the leaf-spring 40 is moved, and, simultaneously, the roller 70 seated on the roller fixing shaft 23 of the body 20 is rotated to resiliently stretch the leaf-spring 40.

A moving range of the cover 10 is limited by the locking boss 13 of the upper cover 10, and the locking boss 13 moves between the hole 22 and the detachable bosses 21.

As the results, it prevents the leaf-spring 40 from being overly relaxed by limiting the drawing range of the leaf-spring 40.

In addition, the leaf-spring is coupled to the center portions of the cover 10 and the body 20, respectively, so that the cover 10 is correctly moved without occurring the offset.

In case that the abdomen of the wearer is expanded or retracted according to the wearer after meals or his/her posture's change, with the wearer putting on the belt 60, the leaf-spring 40 is resiliently retracted, thereby preventing an oppressive sensation on the abdomen of the wearer and preventing the trousers from being slip down due to the loose belt.

The self-adjusting device 1 and the buckle 50 are adapted to be exchanged, so that the wearer can easily exchange the buckle 50 to follow the fashion.

With the constructions, in case that the abdomen of the wearer is expanded or retracted according to the wearer after meals or his/her posture's change, with the wearer putting on the belt, the leaf-spring is resiliently retracted, thereby preventing an oppressive sensation on an abdomen of the wearer to be helpful to the activation of the abdominal function and preventing the trousers from being slip down due to the loose belt.

In addition, the leaf-spring is coupled to the center portions of the cover and the body, respectively, so that the cover is correctly moved without occurring the offset. The roller fixing shaft is provided in a shape of cylindrical column, so that when the leaf-spring is stretched, the center portion of the rotating roller is prevented from being abraded to improve the reliability of the operation.

The self-adjusting device and the buckle are adapted to be exchanged, so that the wearer can easily exchange the buckle to follow the fashion changed from time to time, thereby saving the purchasing cost.

The forgoing embodiment is merely exemplary and is not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An exchangeable self-adjusting device for use in a belt, one side of the self-adjusting device being coupled to an end of the belt, and the other side thereof being coupled to a buckle, the self-adjusting device comprising:

a cover 10 including a cover hook 12 formed at a front thereof and inserted into a buckle hook 51 provided at a rear of a buckle 50, and a leaf-spring hooking boss 11 with a hooked groove 11*a* formed at its center;

a body 20 including detachable bosses 21 protruded from both sides thereof, a roller fixing shaft 23 formed at a center of a bottom thereof for rotatably fixing a roller 70, and a hinge protruded from both sides of the rear thereof towards the bottom and having a hinge hole 22;

a bottom plate 30 including a detachable portion 33 detachably engaged to the detachable bosses 21 of the body 20, a strip biting projection 31 formed in a spike shape for biting the strap 60 and extended integral with a hinge boss 32 of the bottom plate 30, and the hinged bosses 32 protruded from both sides of the strip biting projection 31 and inserted into the hinge hole 22 of the body 20; and a leaf-spring 40 wound many times around the roller 70, and including a leaf-spring hook 41 with its end bent in a U-shape to be inserted and secured to a hooked groove 11*a* of the leaf-spring hooking boss 11.

* * * * *